US005359756A

United States Patent [19]

Miyauchi et al.

[11] Patent Number: 5,359,756

[45] Date of Patent: Nov. 1, 1994

[54] AUTOMATIC BUCKLING DEVICE

[75] Inventors: Kiyotaka Miyauchi; Tetsuya Hamaue, both of Shiga, Japan

[73] Assignee: Takata Corporation, Tokyo, Japan

[21] Appl. No.: 183,407

[22] Filed: Jan. 18, 1994

[30] Foreign Application Priority Data

Jan. 26, 1993 [JP] Japan ..... 5-010867

[51] Int. Cl.[5] ..... A44B 11/00

[52] U.S. Cl. ..... 24/603; 24/633; 24/640

[58] Field of Search ..... 24/603, 602, 606, 607, 24/608, 610, 611, 588, 633, 639, 640

[56] References Cited

U.S. PATENT DOCUMENTS

| | | | |
|---|---|---|---|
| 3,146,846 | 9/1964 | Gutshall | 24/603 |
| 3,311,188 | 3/1967 | Gutshall | 24/603 |
| 4,126,919 | 11/1978 | Lassche | 24/602 |
| 4,644,616 | 2/1987 | Ferry | 24/603 |
| 4,815,177 | 3/1989 | Mackew | 24/603 |
| 5,274,890 | 1/1994 | Shimizu et al. | 24/603 |

*Primary Examiner*—Victor N. Sakran
*Attorney, Agent, or Firm*—Kanesaka & Takeuchi

[57] ABSTRACT

A tongue includes a tongue base which can project therefrom and a tongue face plate at the forward end thereof. A buckle includes a solenoid provided at the forward end so as to attract the tongue face plate. After the tongue base is inserted into the buckle, the tongue base is drawn deep into the buckle by the pawl portion of a long hook, rocking arms are engaged with the notched portions of the tounge base, and a latch plate comes into close contact with the claw portions of the rocking arms at the back sides of the claw portions, thereby latching the tongue base. The latch plate and the long hook are advanced and withdrawn by a pinion which is rotated by a stepper motor. When the pinion is reversely rotated, the tongue base is released from the latched state, and the tongue base is pushed out of the buckle by an ejector, thereby separating the tongue from the buckle.

5 Claims, 9 Drawing Sheets

AUTOMATIC BUCKLING DEVICE

BACKGROUND OF THE INVENTION

1. Field of the Invention

The present invention relates to an improvement of a mechanism for connecting a tongue and a buckle of a seat belt apparatus which is installed in vehicles or the like and, more particularly, to an automatic buckling device for automatically connecting the tongue with the buckle when the tongue is brought close to the buckle.

2. Description of the Related Art

When an occupant uses a seat belt apparatus installed in an automobile, a tongue attached to a seat belt is manually inserted into a buckle.

Since the buckle is disposed on one side of a seat, the occupant must twist the upper half of his body in an uncomfortable posture in order to insert the tongue into the buckle.

OBJECT AND SUMMARY OF THE INVENTION

Accordingly, it is an object of the present invention to eliminate the above-described problems in the related art and to provide an automatic buckling device which enables a tongue to automatically insert into a buckle by utilizing a motor or the like.

To achieve this aim, in a first aspect of the present invention, there is provided an automatic buckling device having a mechanism of drawing a tongue base into a buckle by a hook which is driven by a motor or the like, retaining the tongue base by rocking arms, and checking the withdrawal of the rocking arms by a latch plate, thereby latch-holding the tongue base.

An automatic buckling device provided in a second aspect of the present invention adopts a rack-and-pinion mechanism as a driving mechanism. In an automatic buckling device provided in a third aspect of the present invention, a hook (long hook) is rocked with the advance or withdrawal of a rack of the rack-and-pinion mechanism. In an automatic buckling device provided in a fourth aspect of the present invention, a tongue is attracted to a solenoid.

In an automatic buckling device of the present invention, when the tongue base is inserted into an entrance portion of the buckle, the hook is engaged with a hole of the tongue base, so that the hook is withdrawn. By this operation, the tongue base is drawn into the admission space within the buckle. When the tongue base advances in the admission space, the tongue base pushes an ejector inward. The ejector then pushes the base end portions of the rocking arms sideways, and the forward end portions of the rocking arms then enter the admission space. The forward end portions of the rocking arms thus engage the notched portions of the tongue base on both side surfaces.

The latch plate is then moved by a driving mechanism to the back sides of the forward end portions of the rocking arms so as to check the withdrawal of the forward end portions of the rocking arms from the admission space, thereby maintaining the locked state of the tongue base.

In order to separate the tongue from the buckle, the latch plate is moved from the back sides of the forward end portions of the rocking arms by the driving mechanism. This movement allows the forward end portions of the rocking arms to withdraw from the admission space. When the forward end portions of the rocking arms withdraw from the admission space and the ejector advances in the admission space, the tongue base is pushed out of the buckle.

In an automatic buckling device provided in the second aspect of the present invention, the long hook and the latch plate are advanced and withdrawn by the motor through the rack-and-pinion mechanism, thereby drawing, locking or releasing the tongue base into, to or from the buckle.

In an automatic buckling device provided in the third aspect of the present invention, the pin connecting the base end of the long hook with the rack for drawing the long hook is moved within the inclined slit of the rack together with the advance or withdrawal of the rack. With this movement, the pawl portion at the forward end of the long hook is drawn into or pushed out of the admission space for the tongue hook.

In an automatic buckling device provided in the fourth aspect of the present invention, a tongue face plate is magnetically attracted to the solenoid, so that the forward end surface of the tongue is attracted to the buckle.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1:
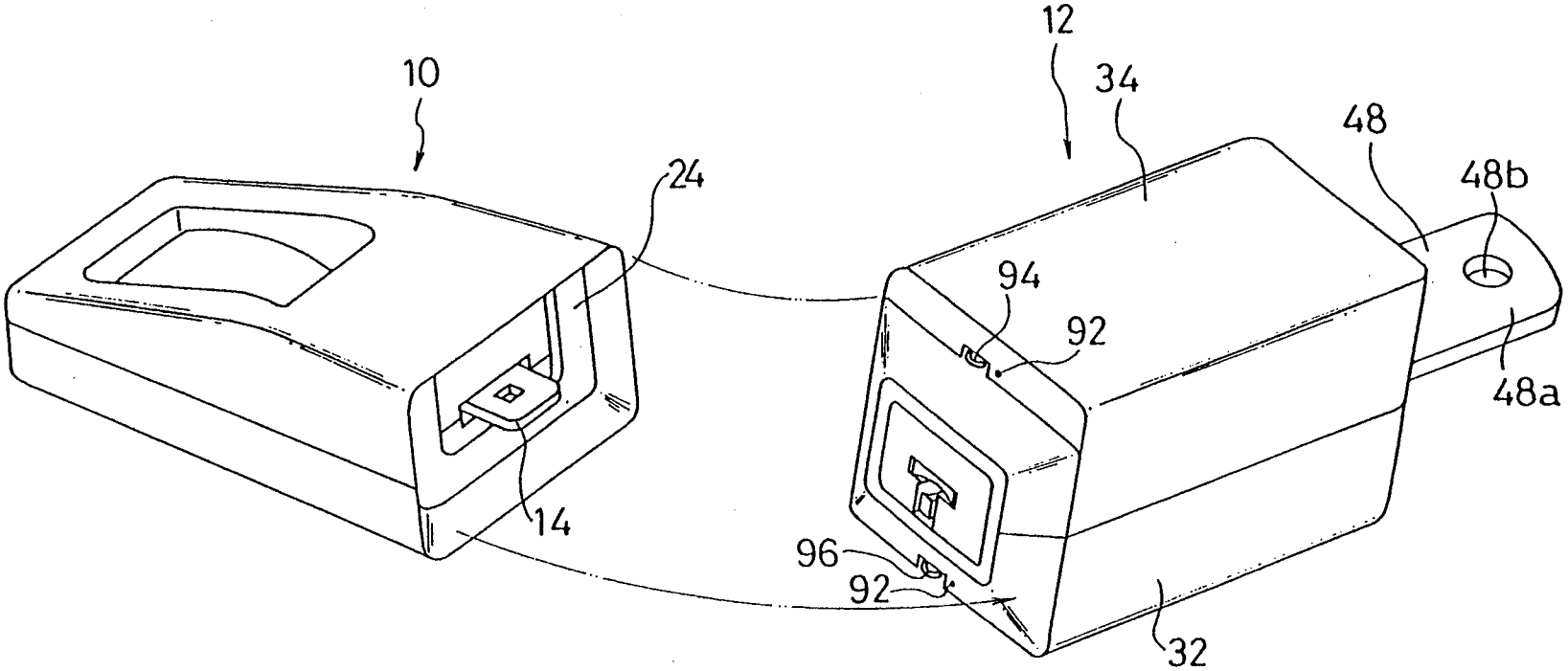
FIG. 1 is a perspective external view of the entire part of an embodiment of an automatic buckling device according to the present invention.
Figure 2:
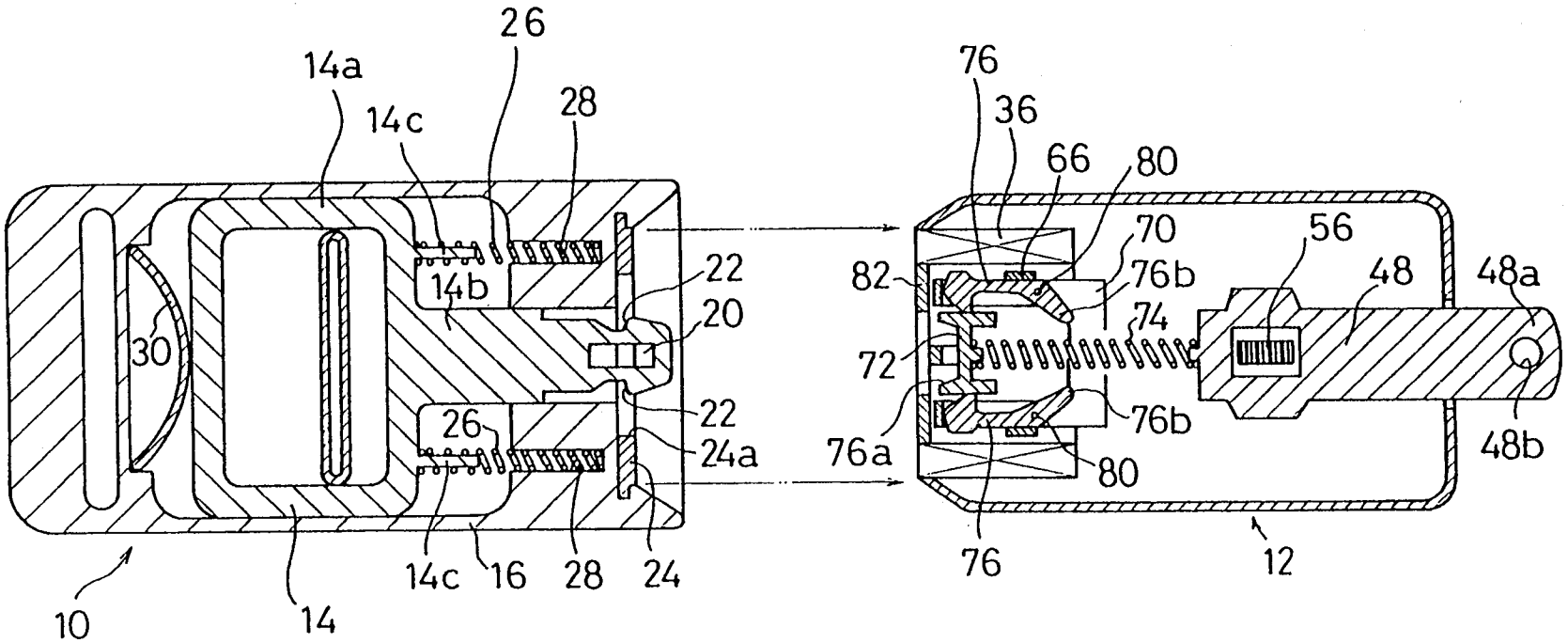
FIG. 2 is a sectional view of the embodiment shown in FIG. 1 in a separated state.
Figure 3:
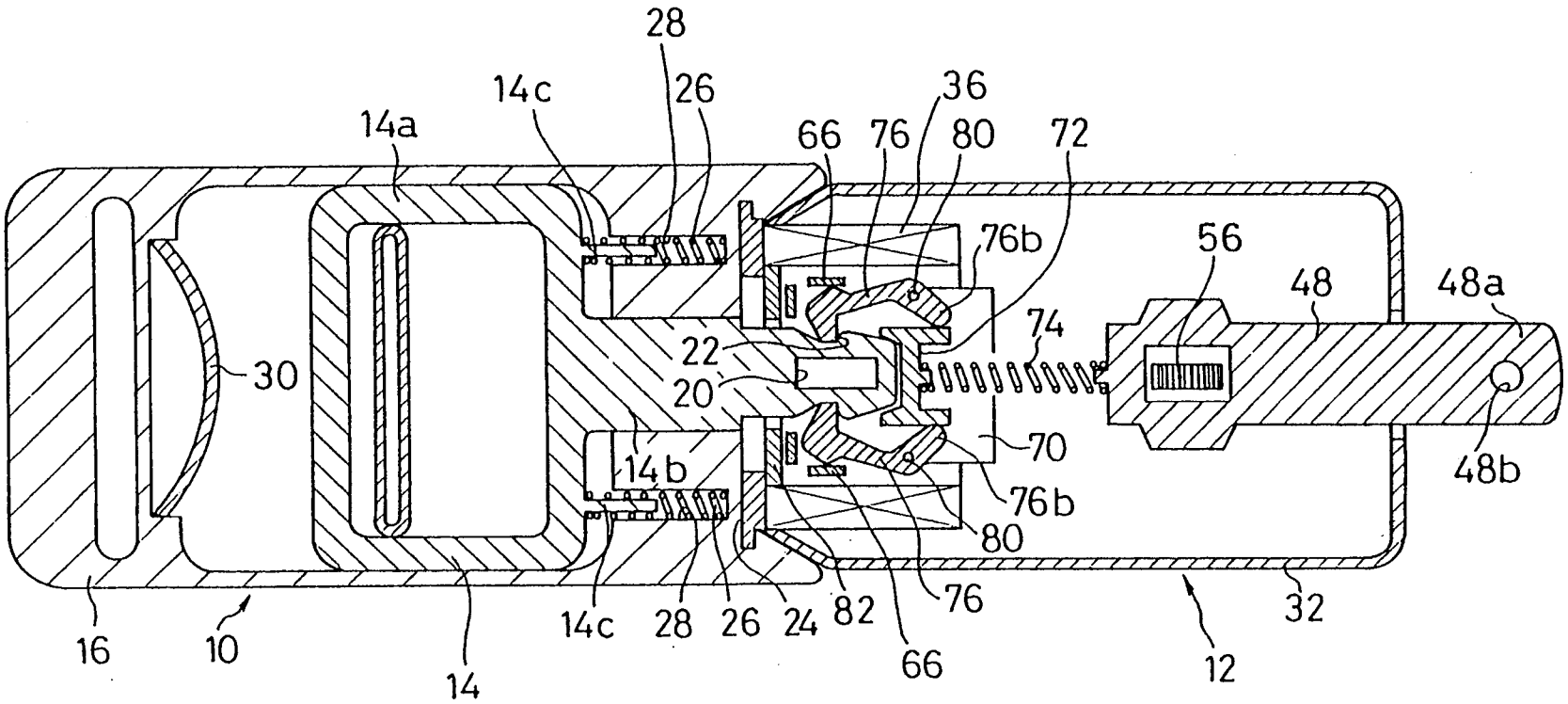
FIG. 3 is a sectional view of the embodiment shown in FIG. 1 in a connected state.
Figure 4:
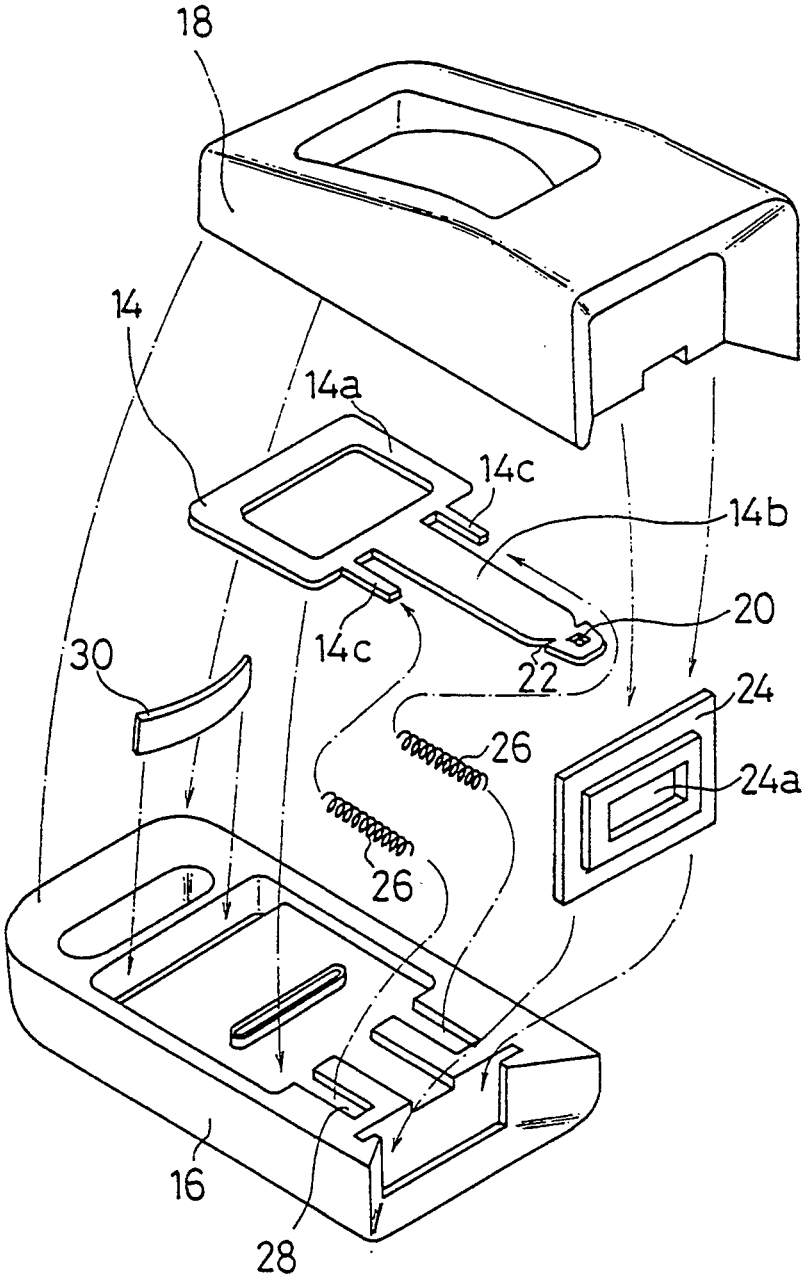
FIG. 4 is an exploded perspective view of the tongue in the embodiment shown in FIG. 1.

An embodiment of an automatic buckling device according to the present invention will be explained hereinunder with reference to the accompanying drawings. FIG. 1 is a perspective view of an embodiment of an automatic buckling device according to the present invention; FIG. 2 is a sectional view thereof; FIG. 3 is a sectional view thereof in the connected state; FIG. 4 is an exploded perspective view of the tongue; FIGS. 5 to 8 are exploded perspective views of the buckle; FIG.

Figure 6:
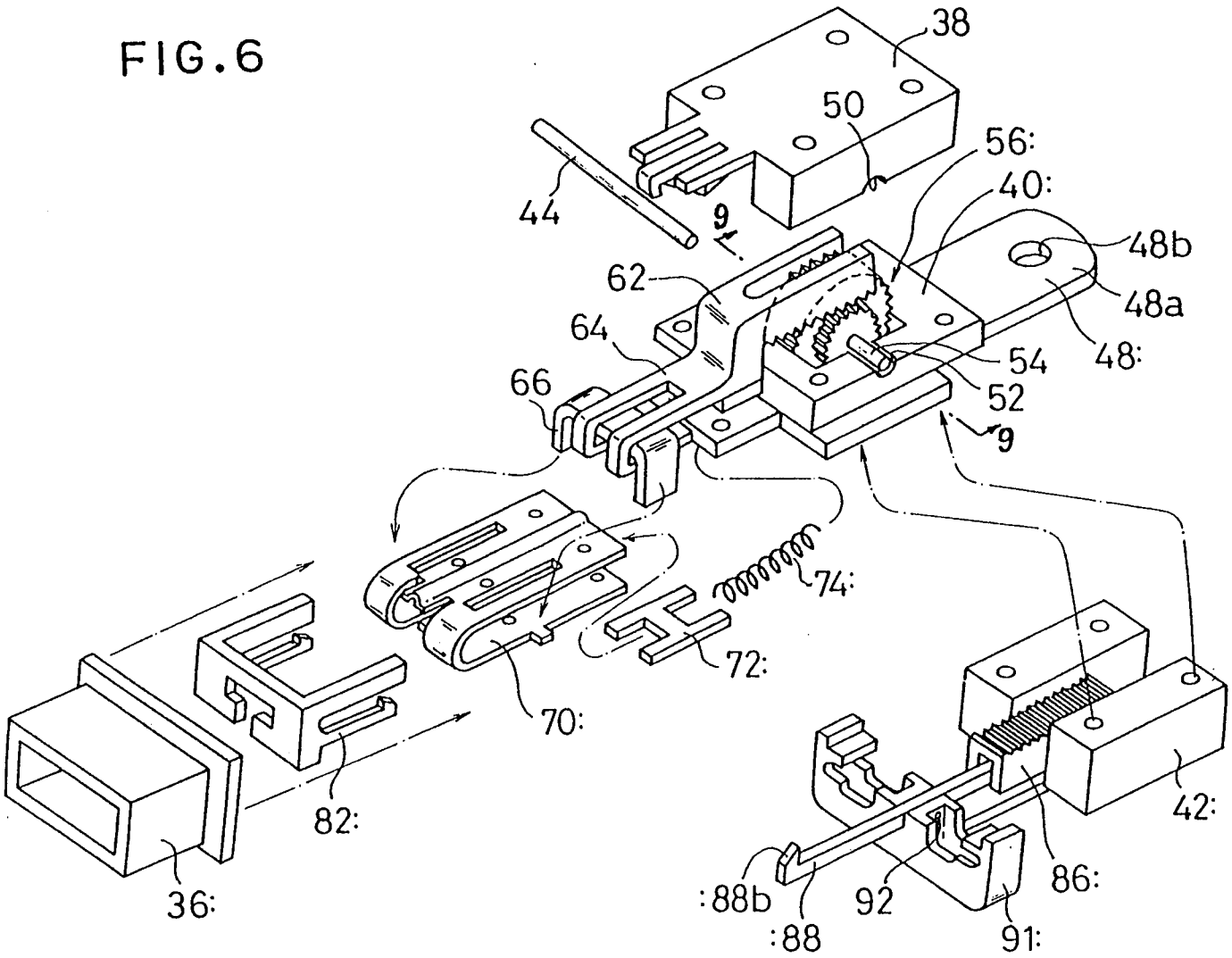
FIG. 6 is an exploded perspective view of the buckle shown in FIG. 5.
Figure 10:
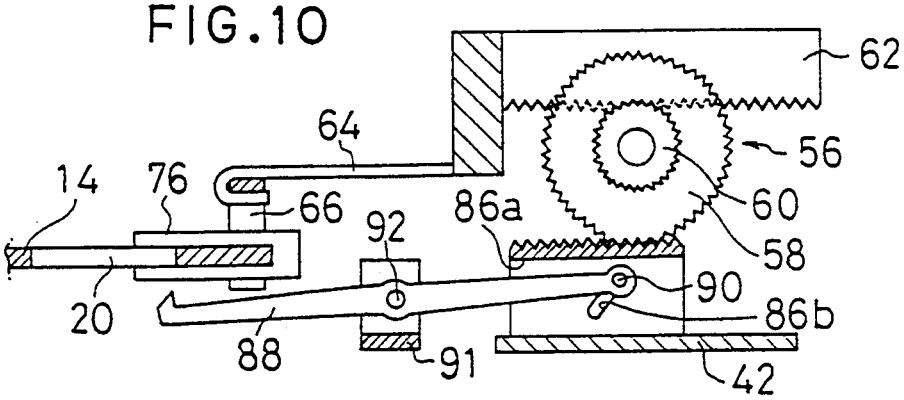
FIG. 10 is a sectional view of the locking rack and the hook drawing rack of the buckle shown in FIG. 5, explaining an unlocking operation.
Figure 11:
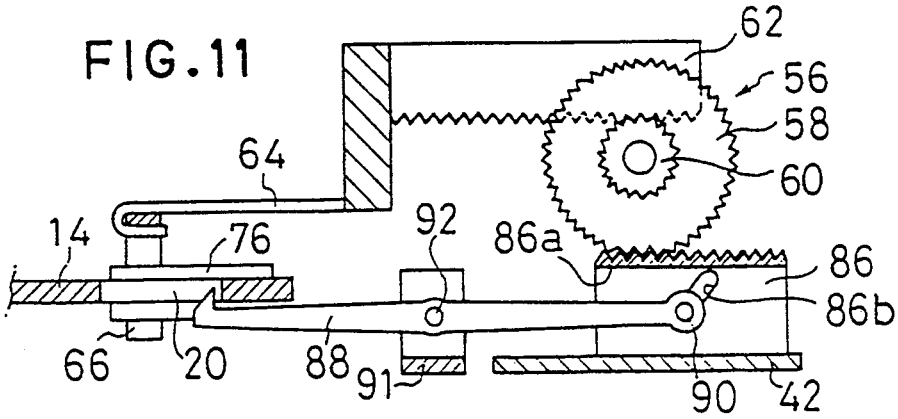
FIG. 11 is a sectional view of the locking rack and the hook drawing rack of the buckle shown in FIG. 5, explaining a locking operation.

9 is a sectional view of the buckle shown in FIG. 6, taken along the line 9—9; and FIGS. 10 and 11 are sectional views of the racks, explaining the operations thereof.

Referring first to FIG. 1, an embodiment of an automatic buckling device according to the present invention is composed of a tongue 10 and a buckle 12. The forward end of a tongue base 14 projects from the forward end surface of the tongue 10, and a large part of the tongue base 14 can be drawn from the tongue 10. The tongue base 14 is drawn into the buckle 12 and latched by a latching mechanism.

The internal structure of the tongue 10 will first be explained with reference to FIGS. 2 to 4. The tongue 10 is composed of the tongue base 14 clamped between a lower tongue cover 16 and an upper tongue cover 18 The tongue base 14 is provided with a frame portion 14*a* which advances and withdraws within the tongue 10, and a projecting portion 14*b* which extends forward from the frame portion 14*a*. The projecting portion 14*b* is provided with a hole 20 at the end and notched portions 22 on both side surfaces.

A frame-shaped metal tongue face plate 24 is provided on the forward end surface of the tongue 10, and the projecting portion 14*b* is inserted into an opening 24*a* at the center of the tongue face plate 24. Two pins 14*c* are projected from the frame portion 14*a* toward the forward end of the tongue 10, and springs 26 are placed over the pins 14*c*. The springs 26 are accommodated in spring receiving grooves 28 provided on the tongue covers 16, 18, as shown in FIGS. 2 and 3. A leaf spring 30 is disposed at the back of the tongue base 14.

The internal structure of the buckle 12 will now be explained with reference to FIGS. 5 to 11. The outer shell of the buckle 12 is composed of a lower buckle cover 32 and an upper buckle cover 34.

Figure 5:
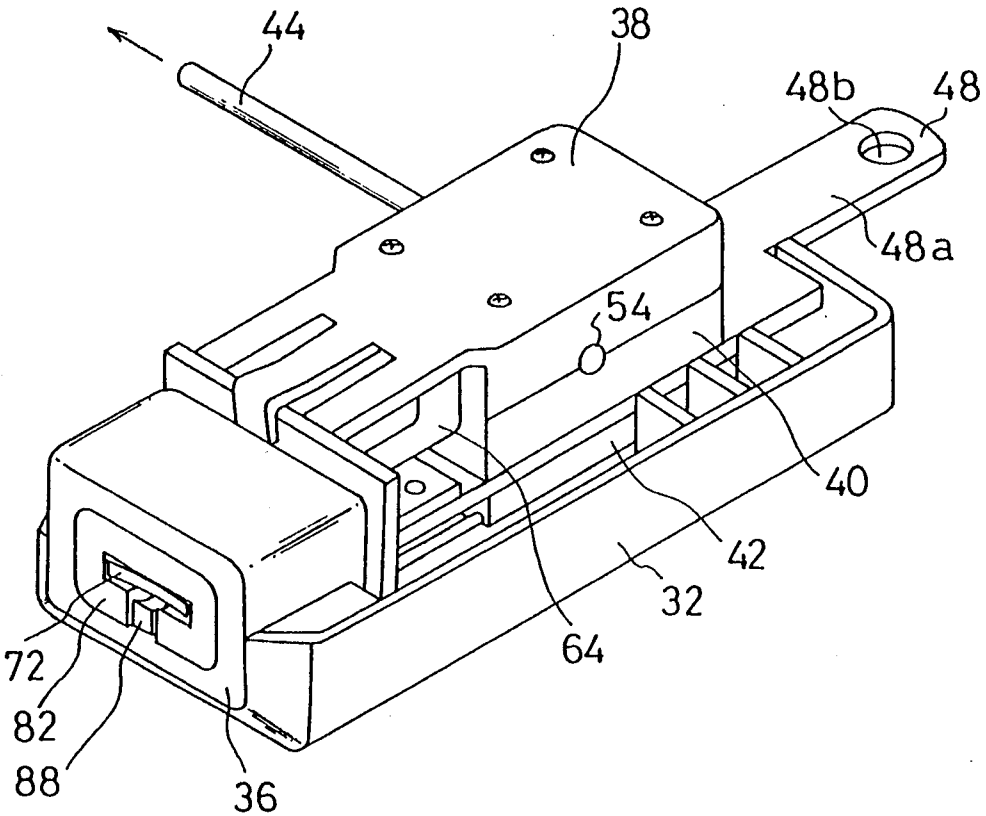
FIG. 5 is a perspective view of the buckle in the embodiment shown in FIG. 1 with the upper buckle cover removed therefrom.

FIG. 5 shows the buckle 12 with the upper buckle cover 34 removed therefrom. As shown in FIG. 5, a solenoid 36 is disposed at the forward end of the buckle 12, and a driving mechanism is accommodated in a housing in the middle portion of the buckle 12. The housing is composed of a first housing member 38, a second housing member 40 and a third housing member 42. A pinion 56 is inserted into the housing members 38, 40, as will be described later. The pinion 56 is connected with a wire 44 which projects sideways from the housing members 38, 40 so that the pinion 56 can be rotated by a stepper motor 46 (shown in FIG. 8). The reference numeral 48 represents a base bracket clamped between the housing members 40 and 42, as shown in FIG. 6. The base end 48*a* of the base bracket 48 extends from the buckle covers 32, 34 so as to be fixed to a vehicle body by a bolt inserted into a bolt insertion hole 48*b*.

Figure 9:
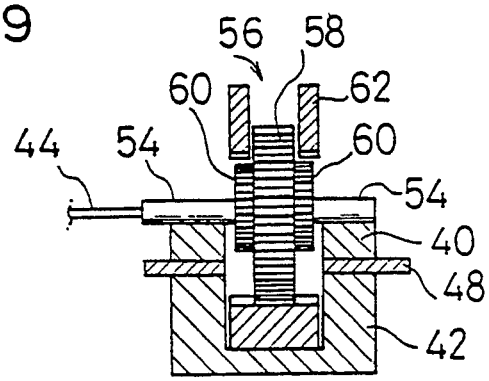
FIG. 9 is a sectional view of the buckle shown in FIG. 6, taken along the line 9—9.

As shown in FIG. 6, shaft grooves 50, 52 are provided on the inner surfaces of the first housing member 38 and the second housing member 40, and the pinion 56 is rotatably held in the housing members 38 and 40 by a shaft 54 which is rotatably accommodated in the shaft grooves 50, 52. The pinion 56 is composed of a center pinion 58 having a large diameter and side pinions 60 having a small diameter, and a locking rack 62 is meshed with the side pinions 60, as shown in FIG. 9.

The locking rack 62 is integral with a latch connector 64 which extends forward within the buckle 12. The forward end of the latch connector 64 is bent back in the shape of the letter U, and a latch plate 66 is inserted into the bent portion. The latch plate 66 is urged forward by a latch spring 68 shown in FIG. 7.

The latch plate 66 has a shape of the letter U and is disposed in such a manner as to be slidable along the side portions of an ejector holder 70. The ejector holder 70 has a long U-shaped section and slidably accommodates an ejector 72. The ejector 72 is urged forward by an ejector spring 74. The inside of the ejector holder 70 affords an admission space into which the tongue base 14 is inserted.

Figure 7:
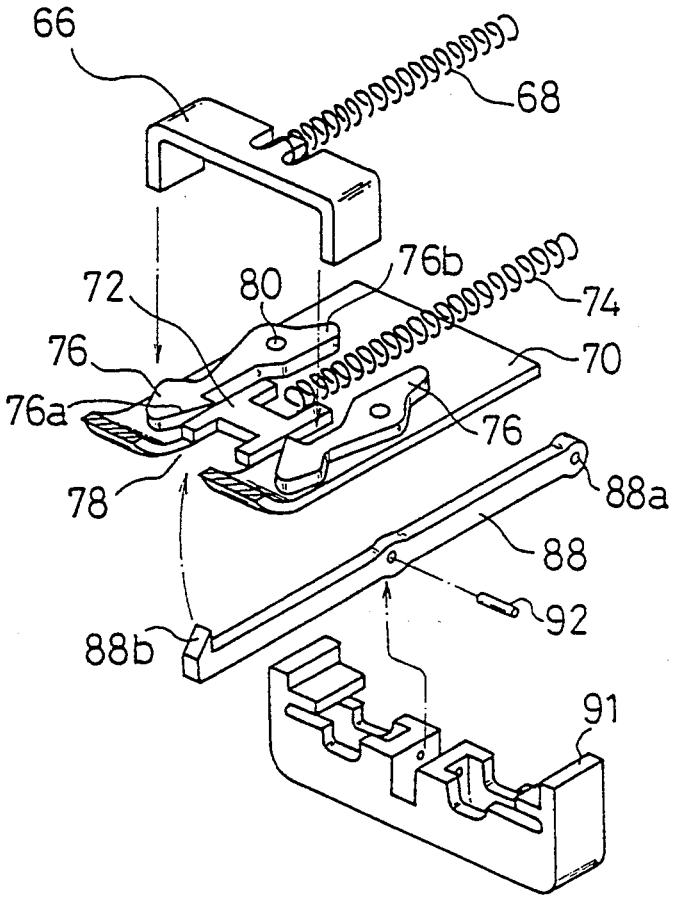
FIG. 7 is another exploded perspective view of the main part of the buckle shown in FIG. 5.

A pair of rocking arms 76 are disposed within the ejector holder 70 in such a manner as to clamp the ejector 72 from both sides. The ejector holder 70 is provided with a slot 78 at the forward end thereof, as shown in FIG. 7, so as to allow the projecting portion 14*b* of the tongue base 14 to be inserted therethrough into the ejector holder 70. The rocking arms 76 are disposed within the ejector holder 70 on both sides of the tongue base admission space, and claw portions 76*a* which engage the notched portions 22 of the tongue base 14 are provided at the forward end portions of the rocking arms 76.

The longitudinal middle portions of the rocking arms 76 are pivotably supported on the ejector holders 70 by pins 80 so that the claw portions 76*a* enter or withdraw from the admission space by the pivotting operation of the rocking arms 76.

The rear end portions 76*b* of the rocking arms 76 are disposed within the admission space when the tongue 10 is separated from the buckle 12, as shown in FIG. 2, and when the ejector 72 is pushed backward, the rear end portions 76*b* of the rocking arms 76 are pushed outside of the admission space, as shown in FIG. 3. The reference numeral 82 in FIG. 6 represents an entrance guide which is inserted into the solenoid 36.

Figure 8:
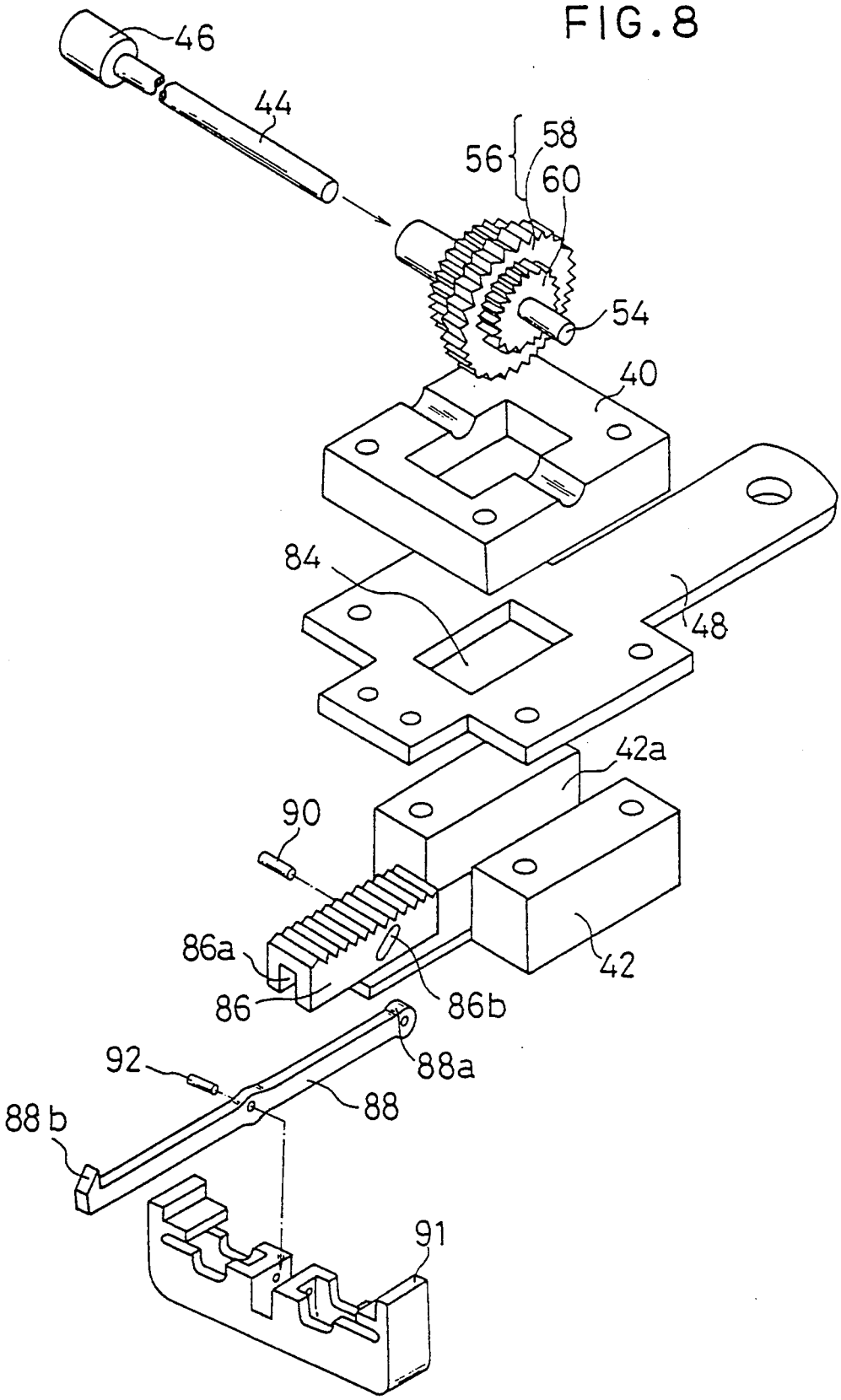
FIG. 8 is still another exploded perspective view of the main part of the buckle shown in FIG. 5.

Referring to FIG. 8, the base bracket 48 is provided with an opening 84, and the center pinion 58 is projected from the under surface of the base bracket 48 through the opening 84. The third housing 42 disposed on the underside of the base bracket 48 is provided at the center portion with a rack guide portion 42*a* extending along the length of the buckle 12. A hook drawing rack 86 is accommodated in the rack guide portion 42*a*.

The hook drawing rack 86 engages the center pinion 58, and advances or withdraws within the rack guide portion 42*a* with the rotation of the center pinion 58. The hook drawing rack 86 has a U-shaped section, as shown in FIG. 8, and the base end portion of a long hook 88 is inserted into the U-shaped groove 86*a*.

A slit 86*b* is provided in the hook drawing rack 86 in such a manner as to extend obliquely to the longitudinal axis of the hook drawing rack 86 in such a manner that the rear end portion of the slit 86*b* approaches the base bracket 48. The long hook 88 is pivotably supported within the hook drawing rack 86 by a pin 90 which is inserted into the slit 86*b* and a hole 88*a* at the base end of the long hook 88.

A pawl portion 88*b* is provided at the forward end of the long hook 88. The longitudinal middle portion of the long hook 88 is pivotably supported on a slider 91 by a pin 92. The slider 91 is held by the ejector holder 70 in such a manner as to withdraw and advance in the direction of insertion of the tongue base 14. As shown in FIG. 1, a photoelectric sensor 92 and limit switches 94, 96 are provided on the forward end surface of the buckle 12.

In the automatic buckling device having the above-described structure, when the tongue 10 is brought close to the buckle 12, the sensor 92 detects the approach and excites the solenoid 36. By this excitation of the solenoid 36, the tongue face plate 24 is attracted to the solenoid 36, so that the tongue 10 is brought into close contact with the buckle 12 and the forward end portion of the tongue base 14 enters the entrance guide 82 of the buckle 12.

The switches 94, 96 detect the close contact state of the tongue 10 and the buckle 12, and rotates the stepper motor 46 and, hence, the pinion 56 in the normal direction. With this movement, the hook drawing rack 86 is withdrawn and the locking rack 62 is advanced, as shown in FIG. 11. With the withdrawal of the hook drawing rack 86, the pin 90 moves forward in the slit 86*b*, and the base end portion of the long hook 88 moves downward seen in FIG. 11. The pawl portion 88*b* thus moves upward seen in FIG. 11 and engages the hole 20 at the forward end of the tongue base 14.

When the hook drawing rack 86 is further withdrawn in this state, the tongue base 14 is drawn deep into the buckle 12. The tongue base 14 pushes the ejector 72 backward, and the ejector 72 pushes the rear end portions 76*b* of the rocking arms 76 to the outside of the admission space, as shown in FIG. 3. With this movement, the claw portions 76*a* of the rocking arms 76 enter the admission space and engage the notched portions 22 of the tongue base 14 which has entered the admission space.

As described above, the locking rack 62 advances with the normal rotation of the pinion 56 (the side pinions 60), and the latch plate 66 also advances through the latch connector 64. As a result, the latch plate 66 is brought into close contact with the claw portions 76*a* of the rocking arms 76 on the back sides of the claw portions 76*a*, as shown in FIG. 3, thereby checking the withdrawal of the claw portions 76*a* from the admission space. That is, the projecting portion 14*b* of the tongue base 14 which has been drawn into the buckle 12 is latched by the rocking arms 76 and kept from withdrawing.

When this latching operation is completed, the excitation of the solenoid 36 is stopped.

In order to release the tongue base 14 from the latched state, a switch (not shown) is operated so as to reversely rotate the stepper motor 46 and, hence, the pinion 56. With this operation, the hook drawing rack 86 advances and the locking rack 62 withdraws, as shown in FIG. 10. When the hook drawing rack 86 advances, the pin 90 moves in the slit 86*b* and the base end portion of the long hook 88 moves upward seen in FIG. 10. As a result, the pawl portion 88*b* of the long hook 88 moves downward seen in FIG. 10 and slips out of the hole 20 of the tongue base 14. Thereafter, the long hook 88 further advances.

The latch plate 66 withdraws together with the locking rack 62. This state allows the claw portions 76*a* of the rocking arms 76 to withdraw from the admission space. Since the ejector spring 74 pushes the ejector 72, the projecting portion 14*b* of the tongue base 14 is ready to withdraw. The withdrawing force withdraws the claw portions 76*a* of the rocking arms 76 from the admission space. The projecting portion 14*b* of the tongue base 14 is pushed out of the buckle 12 by the ejector 72, so that the tongue 10 is separated from the buckle 12.

As described above, according to the embodiment of an automatic buckling device of the present invention, when the forward portion of the tongue is brought into close contact with the forward end of the buckle, the tongue base is automatically drawn into the buckle, thereby assuming the latched state. Accordingly, the occupant is not required to twist the upper half of his body in order to insert the tongue into the buckle. In other words, the buckling operation of the seat belt apparatus is facilitated. In addition, it is possible to separate the tongue from the buckle only by operating the switch. That is, the unbuckling operation of the seat belt apparatus is also facilitated.

More specifically, the connection of the tongue and the buckle is facilitated, because the hook (long hook) and the latch plate are advanced and withdrawn by the rotation of the pinion; the long hook is rocked when it is advanced or withdrawn so as to insert or remove the pawl portion of the long hook into or from the hole of the tongue base; and the tongue is attracted to the buckle by magnetic force.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. An automatic buckling device comprising:

a tongue accommodating a plate-like tongue base which can project from the forward end of said tongue and a tongue spring which urges said tongue base backward; and a buckle which draws said tongue base of said tongue into the interior of said buckle so as to lock said tongue in said buckle and maintain the connection therebetween;

said tongue base being provided with a hole for receiving a hook at the forward end portion thereof, and notched portions for enabling said tongue base to be latched on both sides thereof;

said buckle including an ejector holder affording an admission space into which said tongue base is inserted, a pair of rocking arms which are engageable with said notched portions of said tongue base, a hook which is engageable with said hole of said tongue base, a latch plate for holding said rocking arms in the state of being engaged with said notched portions, an ejector which is provided in said admission space in such a manner as to be advanced and withdrawn in the direction of insertion of said tongue base, an ejector spring which urges said ejector to push said tongue base backward, a sensor for detecting the approach of said tongue, and a driving mechanism for driving said hook and said latch plate in accordance with a detection signal of said sensor;

said rocking arms extending along the length of said buckle in such a manner as to clamp said tongue base therebetween which enters said admission space, and being provided at the forward end portion thereof with claw portions which engage said notched portions of said tongue base;

the longitudinal middle portions of said rocking arms being pivotably supported by said ejector holder so as to allow the advance and the withdrawal of said claw portions into and from said admission space;

the rear end portions of said rocking arms enter said admission space when said claw portions of said rocking arms are withdrawn from said admission space;

said ejector being disposed between said pair of rocking arms in such a manner as to be engageable with said rear end portions of said rocking arms so that the rear end portion of said ejector pushes said rear end portions of said rocking arms to the outside of said admission space when said ejector withdraws, thereby advancing said claw portions of said rocking arms into said admission space;

said latch plate being disposed on the outside of said pair of rocking arms so as to be movable to the back sides of said claw portions of said rocking arms by said driving mechanism when said claw portions of said rocking arms enter said admission space; and said hook being retained in said hole of said tongue base and moved in the direction of insertion of said tongue base by said driving mechanism, when said tongue base advances in said admission space.

2. An automatic buckling device according to claim 1, wherein said hook is a long hook which extends in the direction of insertion of said tongue base, and a pawl portion which engages said hole of said tongue base is provided at the forward end portion of said long hook; and said driving mechanism includes:

a pinion which is rotated by a motor;

a locking rack and a hook drawing rack which meshe said pinion and which are movable in the direction in which said tongue base advances and withdraws;

a latch connector for connecting said locking rack with said latch plate;

a connecting means for connecting said hook drawing rack with the rear end portion of said long hook; and a slider which pivotably supports the longitudinal middle portion of said long hook and which is movable in the direction in which said tongue base advances and withdraws;

said connecting means advancing said long hook and withdrawing said pawl portion of said long hook from said admission space when said hook drawing rack advances toward the entrance of said buckle, while withdrawing said long hook and causing said claw portion of said long hook to enter said admission space when said hook drawing rack withdraws.

3. An automatic buckling device according to claim 2, wherein, after said tongue base is inserted into said buckle, said tongue base is drawn deep into said buckle by said pawl portion of said long hook, said rocking arms are engaged with said notched portions, and said latch plate comes into close contact with said claw portions of said rocking arms at the back sides of said claw portions, thereby latching said tongue base;

said latch plate and said long hook are advanced and withdrawn by said pinion which is rotated by a stepper motor; and when said pinion is reversely rotated, said tongue base is released from said latched state, and said tongue base is pushed out of said buckle by said ejector, thereby separating said tongue from said buckle.

4. An automatic buckling device according to claim 2, wherein said connecting means includes a slit provided in said hook drawing rack, and a pin which engages said slit and which is inserted into a hole provided at said rear end portion of said long hook;

said slit extending obliquely to the direction in which said hook drawing rack is advanced and withdrawn.

5. An automatic buckling device according to claim 1, wherein said buckle is provided at the forward end thereof with a solenoid which is excited in accordance with a detection signal of said sensor, and said tongue is provided on the forward end surface thereof a metal tongue face plate which is magnetically attracted to said solenoid.

* * * * *